United States Patent [19]

Jahn

[11] Patent Number: 4,615,293

[45] Date of Patent: Oct. 7, 1986

[54] MEDIUM-APPLYING DEVICE IN A PRINTING MACHINE

[75] Inventor: Hans-Georg Jahn, Wiesenbach, Fed. Rep. of Germany

[73] Assignee: Heidelberger Druckmaschinen AG, Heidelberg, Fed. Rep. of Germany

[21] Appl. No.: 636,916

[22] Filed: Aug. 2, 1984

[30] Foreign Application Priority Data

Aug. 3, 1983 [DE] Fed. Rep. of Germany ..... 3327993

[51] Int. Cl.[4] ..... B05C 1/02; B05C 11/10

[52] U.S. Cl. ..... 118/46; 118/212; 118/221; 118/249; 118/255; 118/262

[58] Field of Search ..... 118/46, 221, 222, 255, 118/262, 212, 249

[56] References Cited

U.S. PATENT DOCUMENTS

| | | | |
|---|---|---|---|
| 3,931,791 | 1/1976 | Preuss et al. | 118/236 |
| 4,399,767 | 8/1983 | Simeth | 118/46 |
| 4,446,814 | 5/1984 | Abendroth et al. | 118/46 X |

*Primary Examiner*—Evan K. Lawrence

*Attorney, Agent, or Firm*—Herbert L. Lerner; Laurence A. Greenberg

[57] ABSTRACT

In a printing machine, a medium applicator disposed downstream of printing units of the machine, in travel direction through the machine of a sheet being printed, the medium applicator having an assembly formed of a first roller for taking up medium from a supply container, a second roller for metering a quantity of the medium to be applied, and a third roller for transferring the medium, the third roller having a continuous cylindrical surface with a rubber lining disposed thereon for directly applying the medium onto the sheet, the three rollers being in constant meshing engagement with a sheet-transfer cylinder during application of the medium, the medium applicator further comprising a plate cylinder having a cylindrical surface interrupted by a transverse channel and carrying a flexible relief plate having raised surfaces thereon, and another assembly of rollers for supplying medium from another supply container to the raised surfaces of the flexible relief plate, the plate cylinder being in operative engagement with the third roller.

3 Claims, 1 Drawing Figure

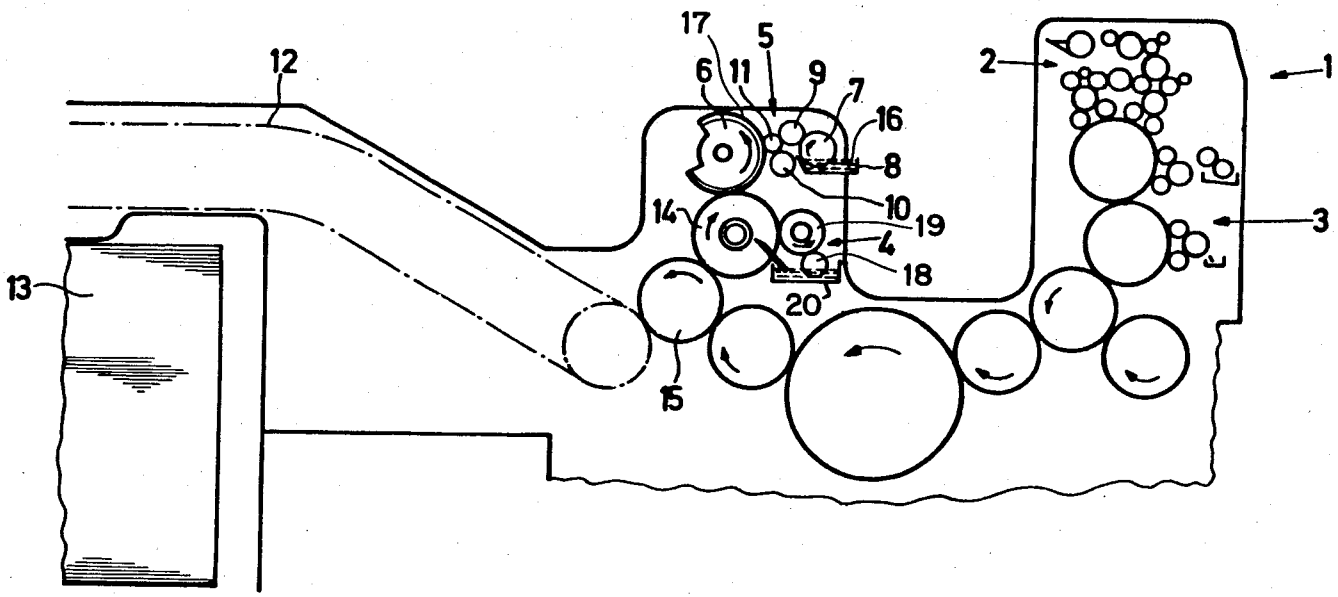
1
2
3
4
5
6
7
8
9
10
11
12
13
14
15
16
17
18
19
20

MEDIUM-APPLYING DEVICE IN A PRINTING MACHINE

The invention relates to a medium applicator in a printing machine and, more particularly, to such a medium applicator which is disposed downstream of printing units of a printing machine, as viewed in travel direction through the machine of a sheet being printed therein, the medium applicator having an assembly formed of a first roller for taking up medium from a supply container, a second roller for metering a quantity of the medium to be applied, and a third roller for transferring the medium, the third roller having a continuous cylindrical surface with a rubber lining disposed thereon for directly applying the medium onto the sheet, the three rollers being in constant meshing engagement with a sheet-transfer cylinder during application of the medium. A medium applicator of this general type has been described in my commonly owned co-pending application Ser. No. 626,732 filed July 2, 1984, now abandoned.

A lacquering or varnishing device in printing machines has become known heretofore from German Published Non-Prosecuted Application No. (DE-OS) 30 46 257. This device includes a lacquer storage tank or supply container and a scooping roller dipping into this tank. The lacquer taken up by the scooping roller is fed in metered fashion to an applicator roller. Two doctor rollers, by means of which a format-related lacquer feed occurs, can be set close to the scooping roller. A ductor blade applicable against the metering roller is also provided. This ductor blade serves to wipe superfluous lacquer from the metering roller and to return it to the supply container.

A specific disadvantage of this heretofore known device is that the lacquer is fed to the varnishing or lacquering cylinder via a distributor roller and an application roller. Because of the relatively long transport distance which the lacquer has to cover over many rollers until it reaches the printed sheet, the lacquer begins to set i.e. no quick-drying lacquers can be used. Due to this limitation to slowly drying lacquers, when the sheet is delivered the reverse side or back of the next following sheet will smear the lacquer and thus paste the sheets together. Consequently, no full sheet piles can be set up, because the pile weight which is built up at the delivery end and which applies a load to the individual sheets also limits the lacquer layer thickness.

In the device described in German Pat. No. 23 45 183 for applying a medium there are provided a dipping roller, a metering roller, an applicator roller, a back-pressure cylinder, a form cylinder and another applicator roller. The two applicator rollers, the dipping roller and the metering roller are combined into a common structural unit. Within this structural unit, either the dipping roller with the form cylinder or the first applicator roller with the form cylinder or the second applicator roller with the back-pressure cylinder can cooperate.

A disadvantage of this last-mentioned construction is that the lacquer must first be fed to the printed material via the form cylinder. The platen mounted on the clamping device at the form cylinder forms a channel in which the lacquer accumulates after a given operating time. This lacquer-accumulation results in an irregular lacquer application due to dripping of the lacquer down onto the printed material.

German Pat. No. 20 20 584 is based upon a device for avoiding smearing of the ink due to lacquering. By means of a lacquering unit, the lacquer is applied to a printing-unit cylinder. This printing-unit cylinder, which has the same diameter as that of the cylinders of the preceding printing units, transfers the lacquer to the printed material. The disadvantages referred to hereinbefore are also applicable to this construction and require additionally, time-consuming cleaning work to be performed on the rollers. Moreover, the construction of the printing unit is complicated by having to attach the lacquering unit to the rubber of blanket cylinder.

A further disadvantage of the state of art as exemplified by the references cited hereinbefore, is that, due to the directions of rotation of the rollers, the format-related wiping by the ductor blade cannot be observed, thus making impossible a precise wiping or removal of the superfluous lacquer material.

It is an object of the invention of the instant application to provided a further improvement over the construction in my aforementioned co-pending application in the form of a supplemental medium-applying device which is suitable especially for coating or lacquering surfaces which are interrupted or spaced from one another and, furthermore, to provide a supplementary medium applicator or lacquering unit for applying coatings or for lacquering with layers of any selected thickness.

With the foregoing and other objects in view, there is provided, in accordance with the invention, in a printing machine, a medium-applicator disposed downstream of printing units of the machine, in the travel direction through the machine of a sheet being printed, the medium applicator having an assembly formed of a first roller for taking up medium from a supply container, a second roller for metering a quantity of the medium to be applied, and a third roller for transferring the medium, the third roller having a continuous cylindrical surface with a rubber lining disposed thereon for directly applying the medium onto the sheet, the three rollers being in constant meshing engagement with a sheet-transfer cylinder during application of the medium, the medium applicator further comprising a plate cylinder having a cylindrical surface interrupted by a transverse channel and carrying a flexible relief plate having raised surfaces thereon, and another assembly of rollers for supplying medium from another supply container to the raised surfaces of the flexible relief plate, the plate cylinder being in operative engagement with the third roller.

In this lacquering device or medium application, it is possible to apply medium or lacquer by means of a flexible relief or letterpress plate which is disposed on a plate cylinder. Fields or sections of the most varied size and shape are provided on this relief plate in order to perform the desired application of medium or lacquering of areas which are interrupted or spaced from one another.

In accordance with a further feature of the invention, the first, second and third rollers and the medium supply container associated therewith form a first-medium applying device, and the plate cylinder, the other assembly of rollers and the other supply container form a supplementary medium-applying device, and means are included for operating the first medium-applying device simultaneously with the supplementary medium-applying device.

In accordance with an added feature of the invention, the medium is a lacquer.

Both medium-applying or lacquering devices are used simultaneously in order to attain a maximum coating thickness of the medium or lacquer at least at predetermined areas of the sheet.

Other features which are considered as characteristic for the invention are set forth in the appended claims.

Although the invention is illustrated and described herein as embodied in medium-applying device in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIGURE of the drawing which is a diagrammatic elevational view of the printing machine having a first lacquering device and a doctor blade assembly arranged at an applicator roller and disposed in front of a delivery unit and, in accordance with the invention, having a supplementary lacquering device located above the first lacquering device.

Referring now to the FIGURE of the drawing, there is shown therein a last printing unit 1 of a printing machine having a conventional inking unit 2 and a conventional dampening unit 3. Following the last printing unit 1, in direction of feed of paper through the printing machine from the right-hand side to the left-hand side of the drawing FIGURE, is a duplex lacquering unit formed of a first lacquering device 4 and a supplementary lacquering device 5 disposed above the first lacquering device 4. Printed sheets are conveyed from the last printing unit 1 to the lacquering devices 4 and 5, respectively. After the consequent treatment or processing of the sheets by the lacquering devices 4 and 5, respectively, the sheets are conveyed further by a delivery chain 12 to a delivery pile 13.

The first lacquering device 4 includes a first roller 18 for taking up medium from a supply container 20, a second roller 19 for metering a quantity of the medium to be applied, and a third roller 14 for transferring the medium, the third roller having a continuous cylindrical surface with a rubber lining disposed thereon for directly applying the medium onto the sheet which is to be processed.

The supplementary lacquering device 5 disposed above the first lacquering device 4 is made up of a lacquer supply vessel or tank 8 wherein a dipping roller 7 rotates, and transfers lacquer successively to a metering roller 9, a distributor roller 10 and an applicator roller 11. The applicator roller 11 is in direct contact with a plate cylinder 6 which is provided with a flexible relief or letterpress plate 17 used for lacquering. The plate cylinder 6 transfers the lacquer applied thereto to the roller 14 which, in turn, is in contact with the sheet-transfer cylinder 15. The sheet-transfer cylinder 15 has non-illustrated grippers which are sunk below the outer cylindrical surface thereof i.e. the back of the gripper is disposed lower than the surface of the sheet which is to be processed. After the consequent processing has been performed, the cylinder 15 surrenders the sheet to the delivery chain or conveyor 12 which then conveys it to the delivery pile 13.

Lacquer 16 is received in the supply tank 8 and serves for suitably treating or processing the sheet after it has been printed. During the rotation of the dipping roller 7, it picks up the lacquer 16 from the supply tank 8 and transfers the lacquer 16 to the metering roller 9. The applicator roller 11 disposed in contact with the metering roller 9 transfers the lacquer 16 to the relief or letterpress plate on the plate cylinder 6 which is formed with suitable recesses. The distributor roller 10 distributes the lacquer uniformly in lacquering regions provided on the applicator roller 11. The format-dependent lacquering operation is effected by means of non-illustrated conventional doctor-blade devices which are attachable to the metering roller 9.

The relief or letterpress plate disposed on the plate cylinder 6 is suitably furnished with surfaces required for the lacquering process. The lacquer 16 adheres to the raised surfaces of the relief plate and at these locations, is transferred to the roller 14. Further transfer of the lacquer is effected via the roller 14 directly to the sheet being printed which is located on the sheet-transfer cylinder 15.

With the foregoing embodiment of the invention, it is possible to provide non-illustrated means either to use the first lacquering unit 4 individually or, if specific breaks or discontinuities i.e. spacings, in the lacquer coating applied to the material being printed are required, to use the supplementary device 5 individually or, if special coating thicknesses of the lacquer is required, to use the duplex lacquering unit, namely both the first lacquering device 4 and the supplementary lacquering device 5 simultaneously.

There are claimed:

1. In a printing machine, a medium applicator disposed downstream of printing units of the machine, in the travel direction through the machine of a sheet being printed, the medium applicator having an assembly formed of a first roller for taking up medium from a supply container, a second roller for metering a quantity of the medium to be applied, and a third roller for transferring the medium, the third roller having a continuous cylindrical surface with a rubber lining disposed thereon for directly applying the medium onto the sheet, the three rollers being in constant meshing engagement with a sheet-transfer cylinder during application of the medium, the medium applicator further comprising a plate cylinder having a cylindrical surface and carrying a flexible relief plate having raised surfaces thereon, and another assembly of rollers for supplying medium from another supply container to said raised surfaces of said flexible relief plate, said plate cylinder being in operative engagement with the third roller.

2. Medium applicator according to claim 1 wherein the first, second and third rollers and the medium supply container associated therewith form a first-medium applying device, and said plate cylinder, said another assembly of rollers and said another supply container form a supplementary medium applying device, and further including means for operating said first medium applying device simultaneously with said supplementary medium applying device.

3. medium applicator according to claim 1 wherein the medium is a lacquer.

* * * * *